US006446882B1

(12) United States Patent
Dukes et al.

(10) Patent No.: US 6,446,882 B1
(45) Date of Patent: Sep. 10, 2002

(54) TRIGGER SPRAYER HAVING SPRAYER/FOAMER SELECTOR NOZZLE CAP

(75) Inventors: Stephen A. Dukes, North Baltimore; George R. Trepina, Holland; Gennaro R. Martire; Wing-Kwong Keung, both of Perrysburg, all of OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 28 days.

(21) Appl. No.: 09/776,103

(22) Filed: Feb. 2, 2001

(51) Int. Cl.[7] ..... A62C 11/00
(52) U.S. Cl. ..... 239/333; 239/390; 222/383.1
(58) Field of Search ..... 239/333, 331, 239/337, 354, 452, 456, 464, 491–497, 526, 539, 570; 222/383.1

(56) References Cited

U.S. PATENT DOCUMENTS

| | | | |
|---|---|---|---|
| 2,132,333 | A | 10/1938 | Wendell et al. |
| 2,790,680 | A | 4/1957 | Rosholt |
| 3,112,885 | A | 12/1963 | Bell et al. |
| 3,377,028 | A | 4/1968 | Bruggeman |
| 3,704,831 | A | 12/1972 | Clark |
| 3,814,326 | A | 6/1974 | Bartlett |
| 3,843,030 | A | 10/1974 | Micallef |
| 3,967,765 | A | 7/1976 | Micallef |
| 4,247,048 | A | 1/1981 | Hayes |
| 4,347,981 | A | 9/1982 | Hayes |
| 4,768,717 | A | 9/1988 | Shay |
| 4,779,803 | A | 10/1988 | Corsette |
| 4,971,252 | A | 11/1990 | Tasaki et al. |
| 5,222,637 | A | 6/1993 | Giuffredi |
| 5,664,732 | A | 9/1997 | Smolen, Jr. et al. |
| 5,755,384 | A | 5/1998 | Foster et al. |

FOREIGN PATENT DOCUMENTS

| | | | |
|---|---|---|---|
| DE | 3442901 | A | 6/1986 |

*Primary Examiner*—Lisa A. Douglas

(57) ABSTRACT

The invention is a trigger sprayer comprising a tubular nozzle bushing and a nozzle cap rotatable on the bushing. The nozzle cap has an end wall with a first swirl chamber formed on the rear face thereof offset from the axis. Passages to a second chamber are diametrically opposite the first chamber. Both chambers have orifices directed out the front of the cap. The first orifices is surrounded by a foaming sleeve. The second orifice is positioned forward of the first orifice so that the spray cone emanating from the second orifice does not hit the foaming sleeve. The cap can be rotated to connect liquid from the delivery tube to the swirl chamber for one or the other orifices.

5 Claims, 5 Drawing Sheets

TRIGGER SPRAYER HAVING SPRAYER/FOAMER SELECTOR NOZZLE CAP

FIELD OF THE INVENTION

This invention relates to a trigger sprayer having a nozzle cap adapted to selectively discharge in the form of a spray or a foam. More specifically, this invention relates to such a nozzle cap adapted rotated to connect either a spray orifice or a foam orifice on the cap with a liquid source from the trigger pump.

BACKGROUND OF THE INVENTION

The prior art is replete with trigger sprayers of various types. An example is disclosed in the McKinney U.S. Pat. No. 4,161,288 wherein the pump comprises a vertically disposed cylinder having a piston stroking as a trigger lever is pulled back and forth. This pumps the liquid from an attached container out a delivery tube to a nozzle.

Typically, trigger sprayers are provided with a nozzle including a rotatable nozzle cap. The delivery tube from the pump usually terminates in a bushing and the cap snaps over the bushing. The delivery tube passes the liquid toward the front end of the cap where it is usually introduced tangentially into a so-called "swirl chamber" on the rear face of the front end of the cap. In the chamber the liquid increases in angular velocity as it swirls toward the orifice and finally discharges in the form of a spray cone.

A shut-off valve may be provided between the bushing and nozzle cap wherein channels in the respective parts align in use, but the flow may be cut off by rotating the cap to an "off" position wherein the channels do not align.

In some sprayers the orifice and swirl chamber have been offset from the axis or the cap. In the Hayes U.S. Pat. No 4,247,048, for instance, the orifice is offset and the discharge may selectively be in the form of a stream or a spray, depending on the depth of the channel on the delivery tube where it communicates with the swirl chamber.

In U.S. Pat. No. 5,664,732 to Smolen, Jr. et al two spray orifices on the cap are diametrically opposed and offset from the axis of the cap. The cap rotates on the nozzle bushing which has a liquid supply on its front face offset from the axis. The separate orifices on the cap produce different spray patterns when connected to the supply.

The concept of a foaming sleeve surrounding the spray cone emitting from a trigger pump orifice is disclosed in the Shay U.S. Pat. No. 4,669,665. Here the cone engages the inside of the foaming sleeve, mixes with air, and discharges as a foam.

The further Shay U.S. Pat. No. 4,768,717 issued Sep. 6, 1988 teaches the idea of introducing air inwardly about the outside of a foaming sleeve to the rear end of the sleeve to enhance the foaming.

A number of prior patents have suggested means in a trigger sprayer for selecting either a foam or a spray type discharge. An example is disclosed in the Shay U.S. Pat. No. 4,767,060 wherein a foaming collar is reciprocally mounted on an annular support extending forward from the nozzle. The sleeve can be moved into either a forward position wherein it is engaged by the emitting spray cone to produce foam, and a rearward position adjacent the orifice wherein the collar is not contacted by the spray, and the discharge is in the form of a spray.

A further disclosure of a selectable spray or foam discharge is found in the Corsette U.S. Pat. No. 4,779,803 wherein a centrally apertured plate has a plurality of rearward legs which telescope into the nozzle cap about the orifice. The plate is movable as the legs slide into the cap or out from it. The plate can be set in a position where the aperture is adjacent the orifice and does not interfere with the spray or is away from the orifice, forward of it, and is impacted by the spray to produce a foam.

More recently foam/spray discharge selectability is disclosed in the Tasaki et al U.S. Pat. No. 5,344,078 and the Foster et al U.S. Pat. No. 5,767,385. In these patents a foaming sleeve or bore is pivotally attached to the side of the nozzle cap on an axis generally perpendicular to the orifice axis so that it can be swung down from an idle position to close to the orifice so that the spray from the orifice contacts the sleeve and a foam discharge is produced.

The pending application Ser. No. 09/753,648 filed Jan. 3, 2001 assigned to our assignee discloses a trigger sprayer having a sprayer/foamer selector wheel in front of the nozzle cap.

SUMMARY OF THE INVENTION

The invention is a trigger sprayer comprising a tubular nozzle bushing and a nozzle cap rotatable on the bushing. The nozzle cap has an end wall with a swirl chamber formed on the rear face thereof offset from the axis. The swirl chamber has an orifice directed out the front of the cap. This orifice is surrounded by a foaming sleeve. A second orifice with its own swirl chamber is positioned forward of the first orifice so that the spray cone emanating from the said other orifice does not hit the foaming sleeve. The bushing and the cap selectively connect liquid from the delivery tube to the swirl chamber for one or the other orifices.

BRIEF DESCRIPTION OF THE DRAWINGS

Further objects and features of the invention will be clear to those skilled in art from a review of the following specification and drawings, all of which present non-limiting forms of the invention. In the drawings.

DESCRIPTION OF THE PREFERRED EMBODIMENT

Figure 1:
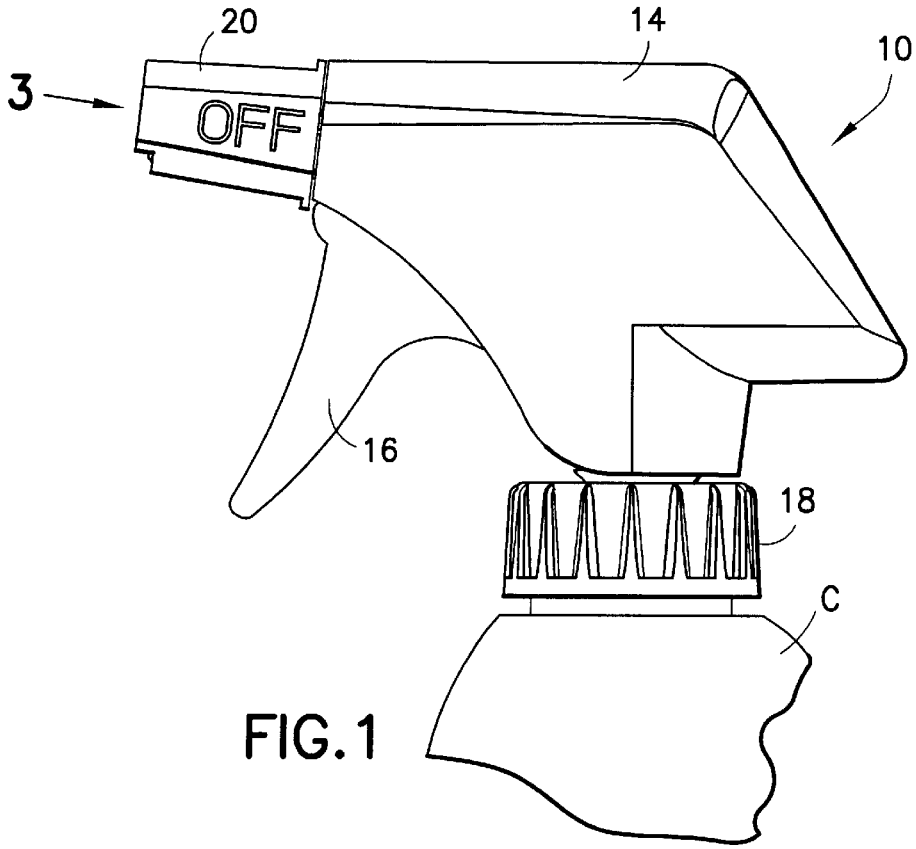
FIG. 1 is a side elevation of a pump dispenser embodying the invention.

A trigger sprayer embodying the invention is generally designated 10 in. FIG. 1. Internally it comprises a pump body 12 which may be of the general type disclosed in the McKinney U.S. Pat. No. 4,227,650. In the embodiment shown the body is covered by a shroud 14. The pump body has pivoted thereto a trigger 16 and is supported on a container C by a threaded closure 18.

Figure 2:
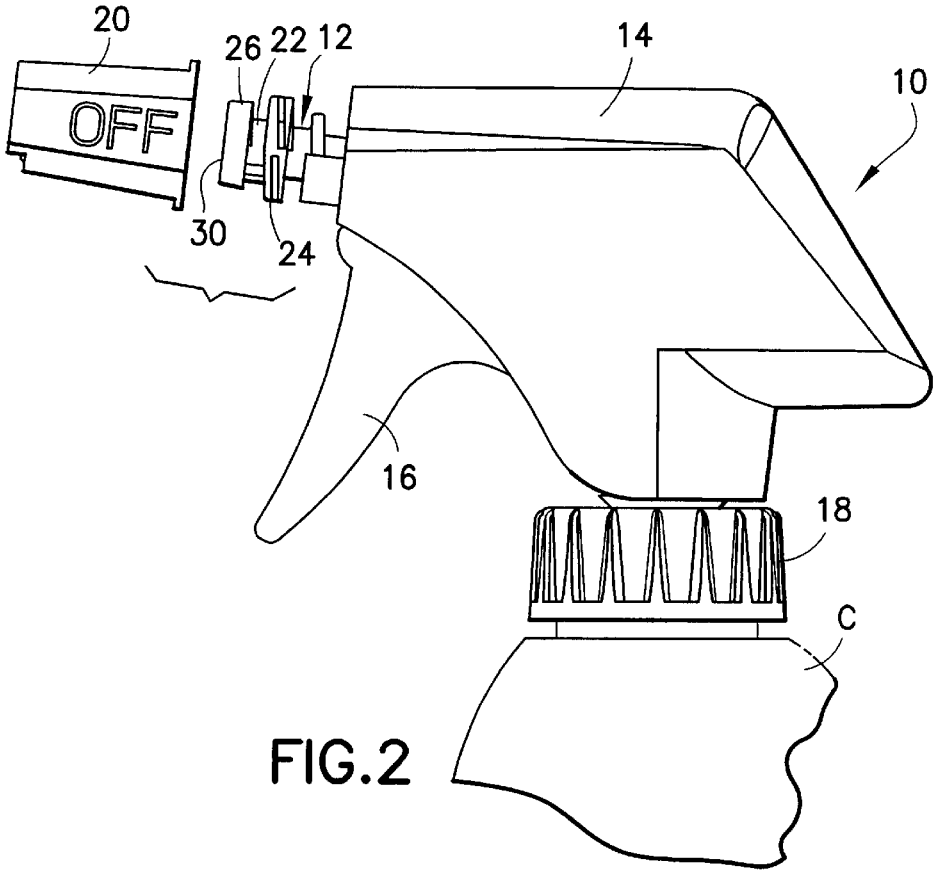
FIG. 2 is an exploded view similar to FIG. 1 showing the nozzle cap removed.
Figure 6:
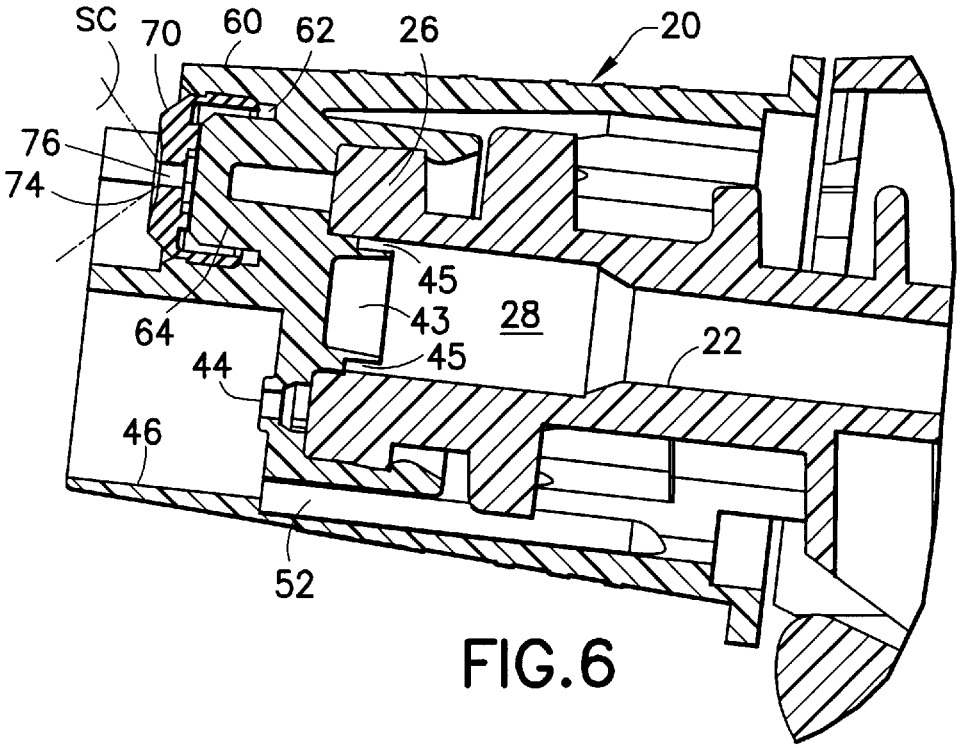
FIG. 6 is a sectional view taken on the line 6—6 of FIG. 3.

Extending forward from the pump body is a delivery tube 22 (FIG. 2) which may include an alignment hub 24 and an annular bushing or flange 26 which surrounds an axial liquid passage 28 (FIG. 6). The annular flange is provided with a flat front face 30.

Figure 5:
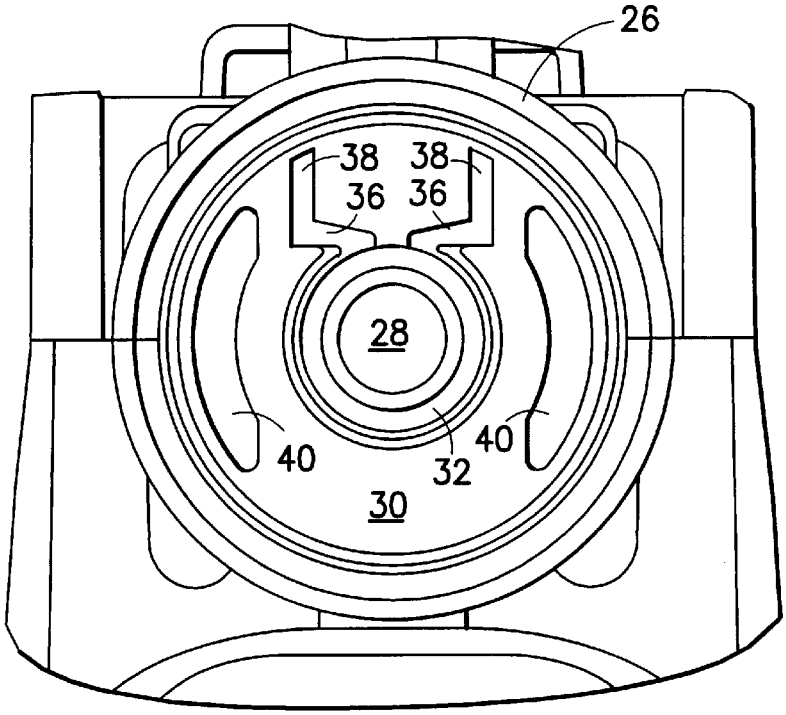
FIG. 5 is a fragmentary view of the front end of the dispenser.

As shown in FIG. 5, the flat face 30 is formed with a chamfer 32 permitting the axial passage 28 to communicate with a pair of discharge passages 36 which together generally form a U-shaped channel terminating in upward spaced parallel legs 38. The front face also presents a pair of flat arcuate lands 40.

Figure 3:
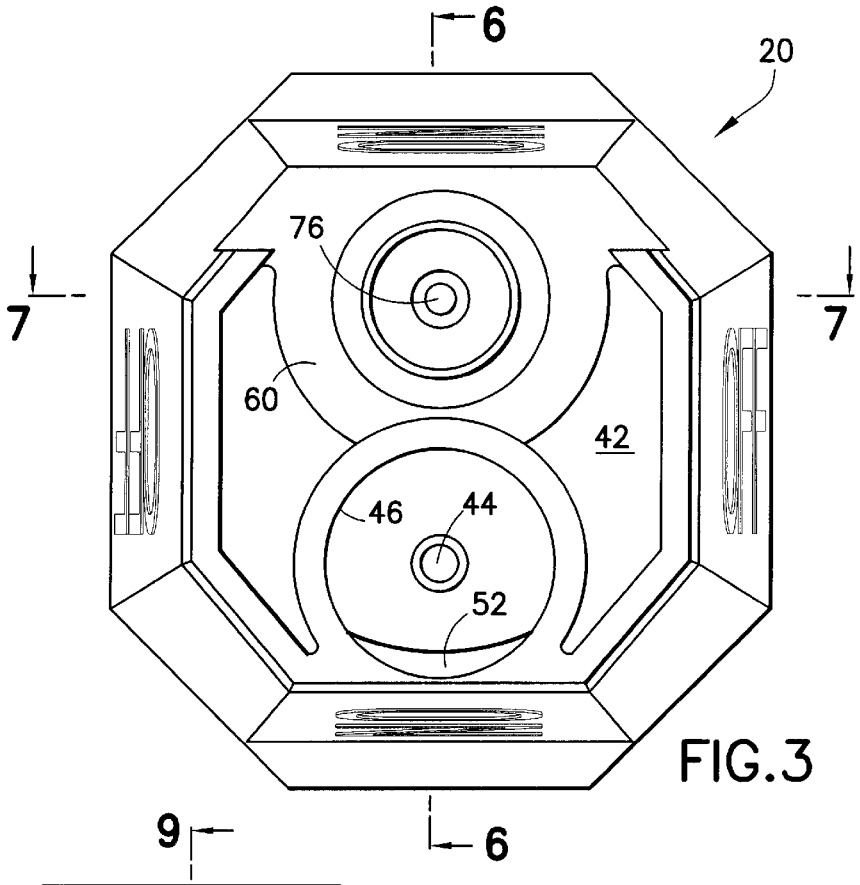
FIG. 3 is an enlarged front elevation of the nozzle cap in position to produce a spray.

The nozzle cap 20 is shown in front view (FIG. 3). It comprises an octagonal body tapering toward the front end. It includes an end wall 42 with a rearward central plug 43 having diametrically opposite liquid channels 45. The tapering side walls extend on forward of the end wall. The end wall is formed with a foam orifice 44 which is surrounded by a concentric forward foaming sleeve 46 molded integrally with the cap 20.

As shown in FIG. 6, the foaming sleeve 46 extends forward sufficiently so that a spray cone emanating from the orifice 44 impinges on the inside of the sleeve.

The orifice 44 (FIG. 4) is surrounded on the rear face of the end wall 42 with a swirl chamber recess 48 larger than the orifice and having a pair of tapered recessed entrance arms 50.

The end wall is apertured at 52 in crescent shape to permit air from the rear of the nozzle cap (FIGS. 6, 9) to be aspirated forwardly into the space defined by the foam sleeve 46 to assist in the foaming of the liquid emanating in a spray cone from orifice 44.

Figure 4:
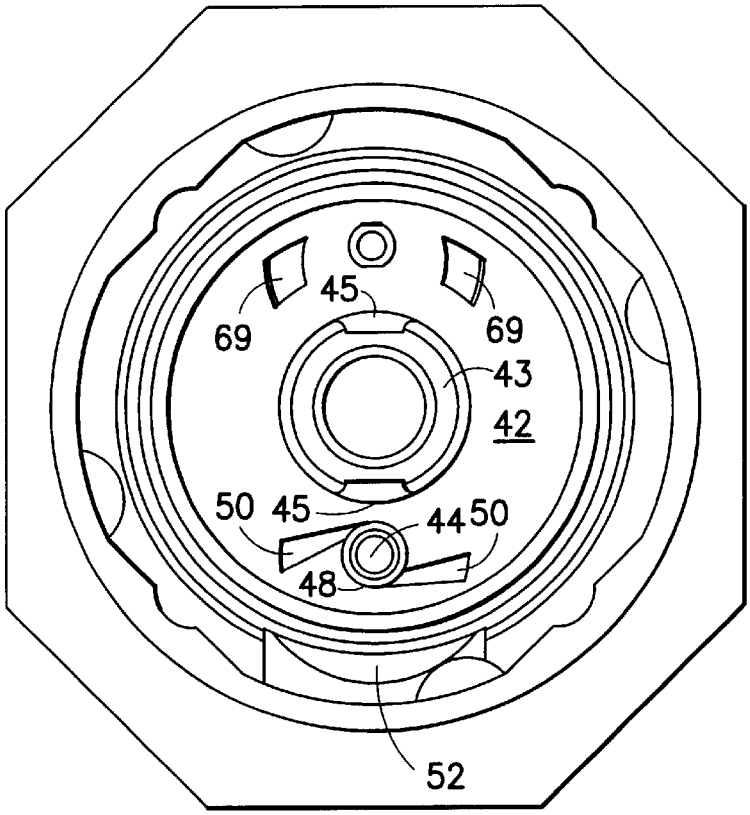
FIG. 4 is a rear elevational view of the cap.

From the sectional view (FIG. 10) it can be seen that the nozzle cap 20 is installed as the annular socket 54 is snapped into the annular flange 26, and the end face 30 is disposed snugly against the rear face of the end wall 42. In this condition, the legs 38 (FIG. 5) are in communication with the entrance arms 50 of the swirl chamber 48 (FIG. 4). One of the outlets 45 in the plug 43 pass liquid from the delivery tube 22, 28 through the axial liquid passage, to the discharge passages 36. Thus, the liquid pumped by the pump body 12 moves into the arms 50 and discharges through the orifice 44 (FIG. 4) in the form of a spray cone. The cone picks up air partly through the opening 52 and foams as it strikes the inside surface of the surrounding foam sleeve 46. This defines the foam mode of the nozzle.

Offset by 180° from the orifice 44 with respect to the axis of the nozzle cap (FIG. 6) is an insert mount 60. The insert mount 60 is a cylindrical projection integral with the cap 20 (FIG. 7) and having centered about its axis an annular well 62 defining a central boss 64. The outside diameter of the well has an undercut 65. The boss has a flat forward surface 66, and a pair of diametrically opposite channels 68 run along the outside of the boss 64 and into ports 69 onto the rear face of the end wall (FIG. 4).

The annular well 62 receives an orifice insert 70, a separate piece which is cup-shaped having a side wall 72. It is comparable to the swirl chamber insert in an aerosol button-type actuator. The side wall snaps into the undercut 65 of the annular well 62 to hold the insert in place with the rear face of its front wall snug against the front face of the boss 64.

The insert 70 is formed with a swirl chamber recess 74 similar to the recess 48. The swirl chamber has a central orifice 76 and the usual entrance arms (not shown) which extend outward to the side walls 72 of the insert and are in liquid communication with the ports 68 and the channels formed in the boss 64 so as to provide passage between the boss 64 and the side walls 72.

Figure 7:
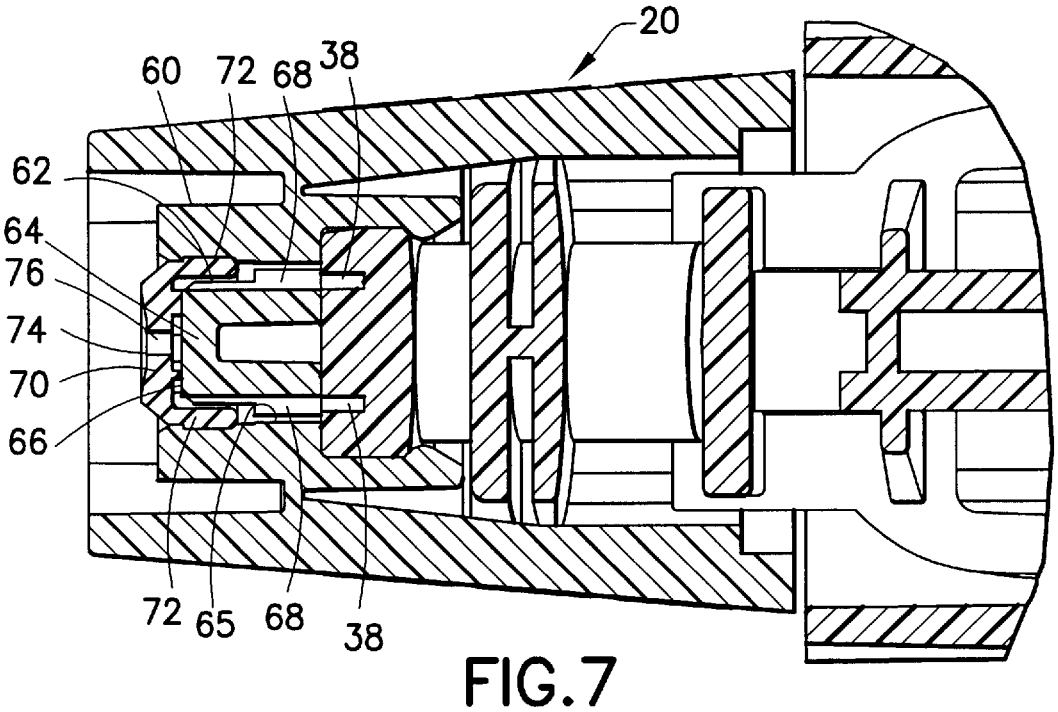
FIG. 7 is a sectional view taken on the line 7—7 of FIG. 3.

With the nozzle cap in the spray position shown in FIG. 3, the relative positions of the legs 38 will be opposite the entrance to the channels 68 (FIG. 7). Liquid will pass, thus, from the legs 38 into the channels 68 along the sides of the boss 64 and forward into the entrance arms (not shown) of the swirl chamber 74 and out the orifice 76. The trigger sprayer is thus in the spray mode.

By having the insert 70 positioned in the insert mount 60, well forward of the wall 42 (FIG. 6), the spray cone SC issuing from the orifice is not intercepted by the foaming sleeve 46 (FIG. 6).

During periods of non-use, the cap 20 may be rotated 90½ from the foam or spray setting to an "off" setting. In this position, the delivery arms 38 (FIG. 5) align with neither the position foaming entrance arms 50 (FIG. 4) or the spray entrance channels 68. Further, the radial outlets 45 (FIG. 4) in the nozzle cap plug 43 do not align with passages 36. This blocks liquid from the delivery tube 22 from entering the discharge passages 36.

Figure 8:
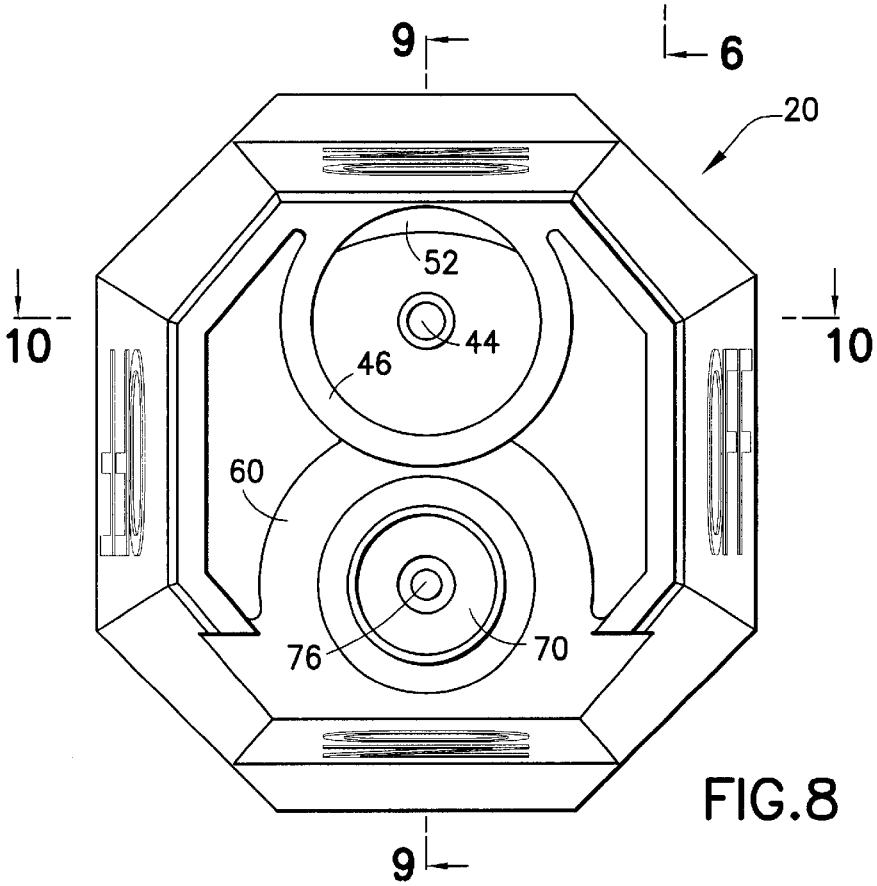
FIG. 8 is a front elevational view of the nozzle cap with the top turned about its own axis 180° as for producing a foam.
Figure 9:
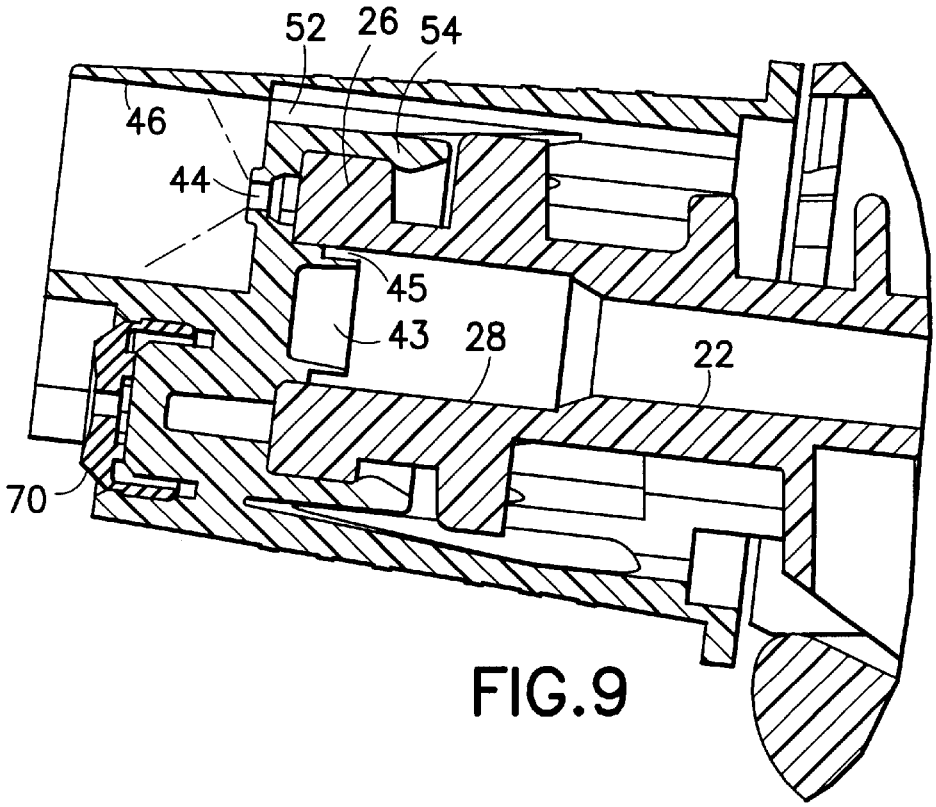
FIG. 9 is a sectional view taken on the line 9—9 of FIG. 8.
Figure 10:
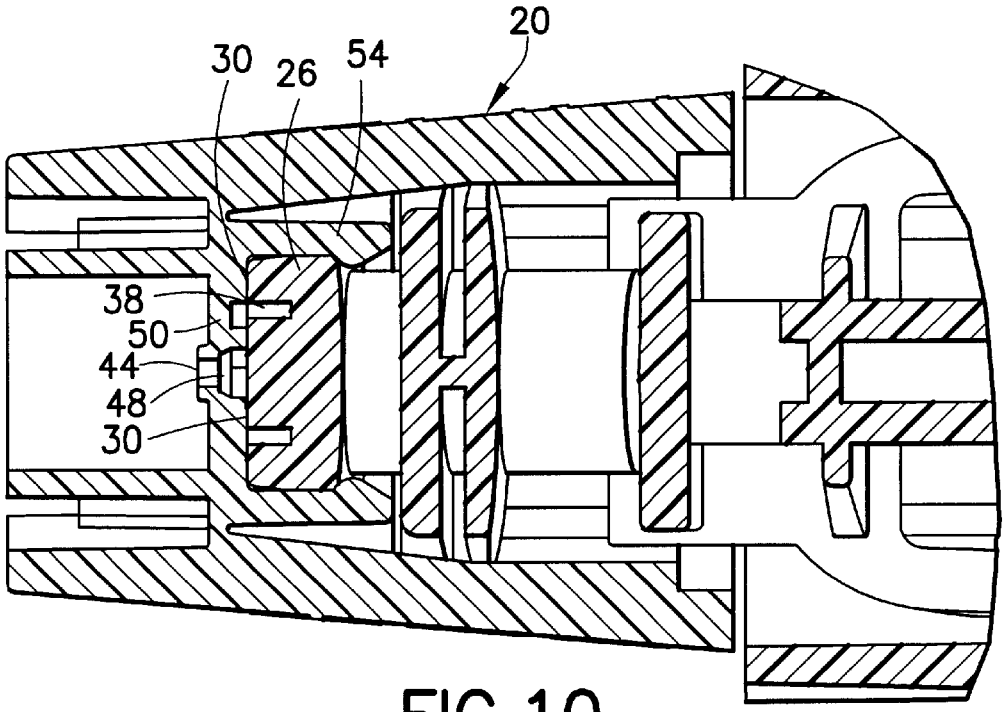
FIG. 10 is a sectional view taken on the line 10—10 of FIG. 8.

The trigger sprayer of the invention thus is adapted to assume selectively one of three modes: 1) the "spray" mode as depicted in FIGS. 3, 6 and 7 wherein the spray cone is emanating from the insert 70; 2) the "foam" mode as presented in FIGS. 8, 9 and 10 and (3) the "off" mode wherein the two orifices 44 and 76 are disposed in the same horizontal plane in which the channels 45 in the plug 43 do not align with the passages 36 and the legs 38 are disposed against the flat face 42. Thus, with a partial rotation of the nozzle cap 20, the dispenser may assume any of three modes mentioned above.

The invention is noteworthy for its compactness and its ability to function without the adjustment of separate parts as is involved in the manipulation axially of a foaming bore or the swinging turn of a foaming plate. All adjustment is made in the present invention by merely partially turning the nozzle cap on the pump.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A method for selecting a foam or spray discharge from a trigger sprayer comprising the steps of:

(a) providing a tubular discharge member having closely spaced openings offset on an end of the member communicating with the interior of the tubular discharge member, (b) providing a nozzle cap rotatably mounted on the end of the tubular discharge member, the cap having a front wall with a rear face, the face having a first and second set of offset ports adapted to align with the spaced openings in the end of the tubular discharge member, the sets leading to tangential entrance arms of respective swirl chambers with orifices, one of the orifices surrounded by a foaming sleeve, the other orifice being forward of the one orifice, and (c) rotating the nozzle cap on the end of the tubular discharge member to the position where the spaced openings on the tubular discharge member align with the selected offset ports.

2. A nozzle for the dispensing of liquids comprising:

a. a tubular member having an axial bore and an annular planar radial end face surrounding the bore, said end face having offset from the axis a set of closely spaced openings in communication with said bore;

b. a cap disposed on the end of the tubular member for rotation about the axis, the cap having an end wall with a planar inside surface engaging the end face the tubular member, the end wall having offset from the axis a first and second set of closely spaced discharge passages adapted when the cap is rotated on the tubular member about the axis to selectively register the closely spaced openings with the first or second set of closely spaced discharge passages, the first set of discharge passages on the end wall of the cap comprising opposite entrance arms of the first swirl chamber formed in the end wall leading to a first discharge orifice through the end wall, a forward foaming sleeve having inner and outer ends surrounding the first discharge orifice, the second set of discharge passages comprising ports in the end wall leading to spaced positions in a forward generally cylindrical insert mount defined by an annular well having a forward central boss, and a cup-shaped boss insert, the insert covering the front of the boss and the insert and the boss between them having a cavity forming a second swirl chamber having opposite entrance arms connected to the ports respectively, the insert having a second discharge orifice forward of the first discharge orifice and intermediate the outer and inner ends of the foaming sleeve.

3. A nozzle as claimed in claim 2 wherein the second orifice is more proximate the outer end of the foaming sleeve than the inner end of the foaming sleeve.

4. A nozzle as claimed in claim 3 wherein the cap has a side wall extending rearward from the periphery of the end wall and an air intake extends into the foaming sleeve through the end wall.

5. A nozzle for a trigger sprayer comprising:

a. a tubular discharge member, b. a nozzle cap rotatable on the discharge member, the nozzle cap having a pair of swirl chambers formed therein with their respective discharge orifices directed out the front of the cap, one of the orifices surrounded by a foaming sleeve, the other orifice being positioned forward of the one orifice so that a spray cone emanating from the other orifice does not engage the foaming sleeve, and c. passages in the cap and tubular discharge member for selectively connecting in liquid communication the swirl chambers for the one or the other orifice to the discharge member.

* * * * *